US008074296B1

(12) United States Patent
Leung

(10) Patent No.: US 8,074,296 B1
(45) Date of Patent: Dec. 13, 2011

(54) HAIR RETAINING HEADWEAR SYSTEM

(76) Inventor: Rosanna M. Leung, Jersey City, NJ (US)

( * ) Notice: Subject to any disclaimer, the term of this patent is extended or adjusted under 35 U.S.C. 154(b) by 459 days.

(21) Appl. No.: 12/264,362

(22) Filed: Nov. 4, 2008

(51) Int. Cl.
*A42B 1/06* (2006.01)

(52) U.S. Cl. ..... 2/172; 2/202; 2/203; 2/204; 2/206; 2/207

(58) Field of Classification Search ..... 2/172, 202, 2/203, 204, 206, 207
See application file for complete search history.

(56) References Cited

U.S. PATENT DOCUMENTS

| | | | | |
|---|---|---|---|---|
| 2,730,722 | A * | 1/1956 | Colangelo | 2/202 |
| 5,590,422 | A | 1/1997 | Henderson | |
| 5,608,914 | A * | 3/1997 | Keesler | 2/207 |
| 5,878,756 | A * | 3/1999 | Bilodeau | 132/274 |
| 6,401,255 | B1 * | 6/2002 | Douglas | 2/207 |
| 6,421,838 | B1 | 7/2002 | Frank | |
| 6,711,749 | B2 | 3/2004 | White et al. | |
| 7,010,815 | B2 | 3/2006 | Tufano-Sisca | |
| 7,360,258 | B2 | 4/2008 | Jaye et al. | |
| 2005/0015849 | A1 | 1/2005 | Norment | |
| 2005/0061345 | A1 | 3/2005 | Srivastava | |
| 2005/0097655 | A1 | 5/2005 | Bascom | |
| 2006/0137074 | A1 * | 6/2006 | Laing | 2/195.2 |
| 2006/0206984 | A1 | 9/2006 | Jaye et al. | |
| 2006/0212996 | A1 * | 9/2006 | McGrath | 2/207 |
| 2007/0094768 | A1 | 5/2007 | Moudgill | |
| 2008/0282447 | A1 * | 11/2008 | Mulaw et al. | 2/172 |

* cited by examiner

*Primary Examiner* — Khoa Huynh
*Assistant Examiner* — Alissa Tompkins
(74) *Attorney, Agent, or Firm* — Neustel Law Offices

(57) ABSTRACT

A hair retaining headwear system for efficiently covering a user's head and retaining their ponytail outside of the headwear. The hair retaining headwear system generally includes a body adapted to be worn over a head of a user, wherein the body includes a forward end adapted to extend around a forehead and a rearward end opposite the forward end. A retaining element extends from the rearward end, wherein the retaining element includes a receiver opening to receive and retain hair extending from underneath the body away from the body.

15 Claims, 6 Drawing Sheets

HAIR RETAINING HEADWEAR SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to headwear and more specifically it relates to a hair retaining headwear system for efficiently covering a user's head and retaining their ponytail outside of the headwear.

2. Description of the Related Art

Any discussion of the related art throughout the specification should in no way be considered as an admission that such related art is widely known or forms part of common general knowledge in the field.

Headwear, such as bandanas and head wraps have been in use for years. The headwear is worn for purposes of comfort, warmth, protection from various elements and absorbing perspiration. The headwear is worn independently and also under various types of headgear or helmets. The headwear is often able to be comfortably worn; however for individuals with long hair the use of the headwear may often times be uncomfortable.

An individual with long hair generally prefers to retain their hair in an orderly manner when wearing the headwear to participate in various types of activities or sports. Retaining the hair in an orderly manner can help to prevent discomfort for the user from the hair bouncing about or positioning itself in front of the individual's eyes when the individual is being active. Retaining the hair in an orderly manner outside of the headwear can also prevent the user from having to "bunch" their hair underneath the headwear thus being a difficult process and causing discomfort.

Adjusting the headwear to accommodate for the plethora of hair may often times cause the headwear to become loosened or misaligned thus making the headwear uncomfortable to wear and not of a sufficient tautness around the head to efficiently retain the individual's perspiration. It is appreciated that at times it may also be desired to simply retain the ponytail, without providing a substantial amount of fabric over the user's head. Because of the inherent problems with the related art, there is a need for a new and improved hair retaining headwear system for efficiently covering a user's head and retaining their ponytail outside of the headwear.

BRIEF SUMMARY OF THE INVENTION

The general purpose of the present invention is to provide a hair retaining headwear system that has many of the advantages of the headwear mentioned heretofore. The invention generally relates to a headwear which includes a body adapted to be worn over a head of a user, wherein the body includes a forward end adapted to extend around a forehead and a rearward end opposite the forward end. A retaining element extends from the rearward end, wherein the retaining element includes a receiver opening to receive and retain hair extending from underneath the body away from the body.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

An object is to provide a hair retaining headwear system for efficiently covering a user's head and retaining their ponytail outside of the headwear.

Another object is to provide a hair retaining headwear system that is adaptable to various types of headwear, such as but not limited to head wraps and bandanas.

An additional object is to provide a hair retaining headwear system that allows for easy removal and attachment of the retaining device that is used for securing the extra hair (e.g. ponytail).

An additional object is to provide a headwear system for securing a bandana type body to a head of a user in a manner so as to prevent an upper flap from flailing about a lower flap.

Other objects and advantages of the present invention will become obvious to the reader and it is intended that these objects and advantages are within the scope of the present invention. To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
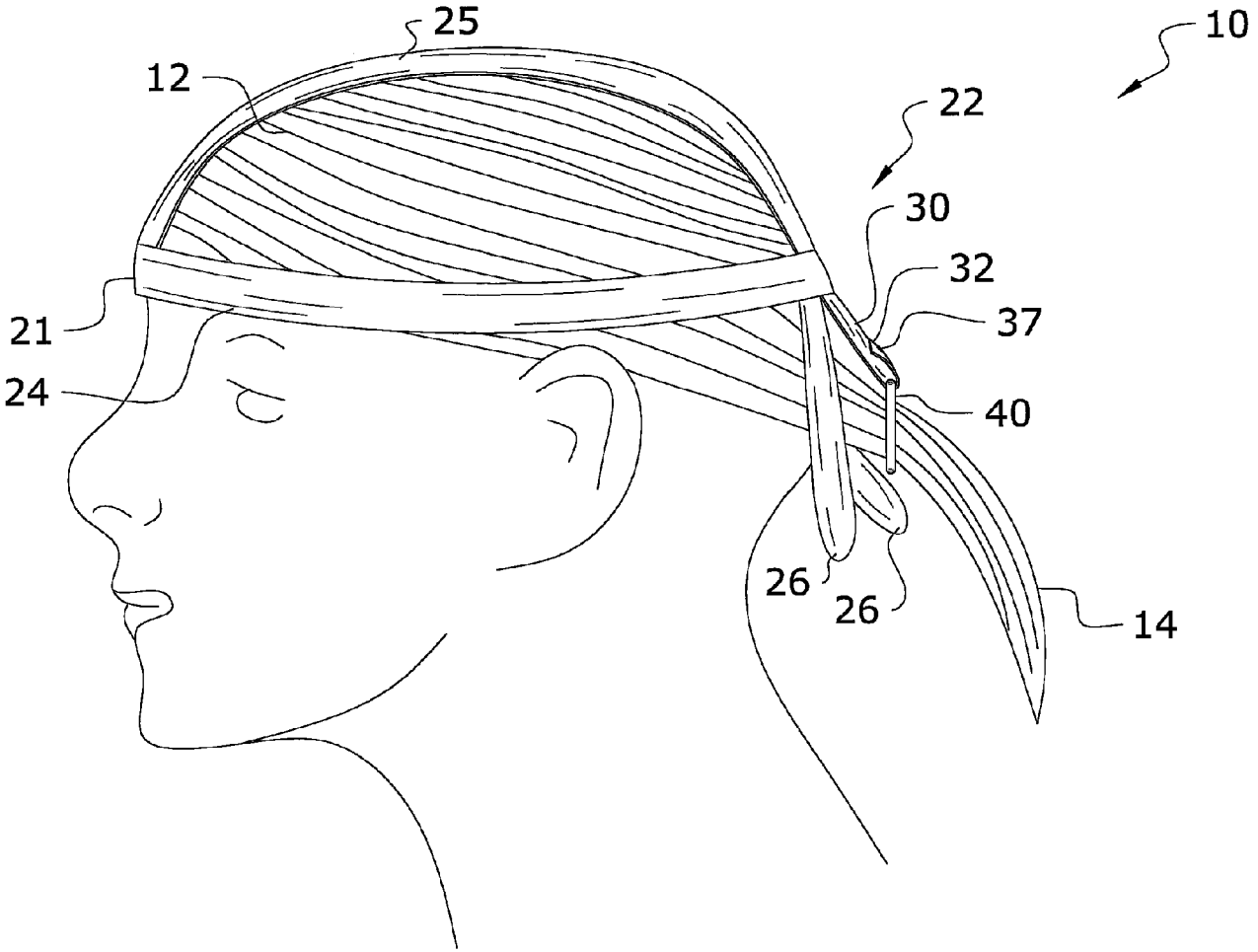
FIG. 1 is an upper perspective view of the present invention in use in accordance with the first embodiment of the present invention.

Turning now descriptively to the drawings, in which similar reference characters denote similar elements throughout the several views, FIGS. 1 through 6 illustrate a hair retaining headwear system 10, which comprises a body 20 adapted to be worn over a head of a user, wherein the body 20 includes a forward end 21 adapted to extend around a forehead and a rearward end 22 opposite the forward end 21. A retaining element 40 extends from the rearward end 22, wherein the retaining element 40 includes a receiver opening 42 to receive and retain hair 12 extending from underneath the body 20 away from the body 20.

B. Body

As stated, the body 20 of the headwear 10 is adapted to be worn over the user's head. The body 20 may serve various purposes, such as increases comfort for the user, warmth, protecting the user's head, keeping the head gear from smelling by absorbing perspiration from the user's head. The body 20 may also cover a substantial portion of the user's head so as to cover the hair 12 atop the user's head or the body 20 may serve to simply extend over the user's head in a manner sufficient to hold the retaining element 40 in place behind the user's head. The body 20 may also be worn independently of any other headgear or may be worn underneath various types of headgear and helmets. In a manner consistent with the preferred embodiment, the forward end 21 of the body 20 is positioned over a portion of the user's forehead so as to retain the front end of the body 20 about the head of the user and the rearward end 22 of the extends around and from the opposite end of the user's head. In the preferred embodiment, the body 20 is comprised of a soft fabric type material; however it is appreciated that other materials may be used with the present invention similar or dissimilar to the fabric.

Figure 2:
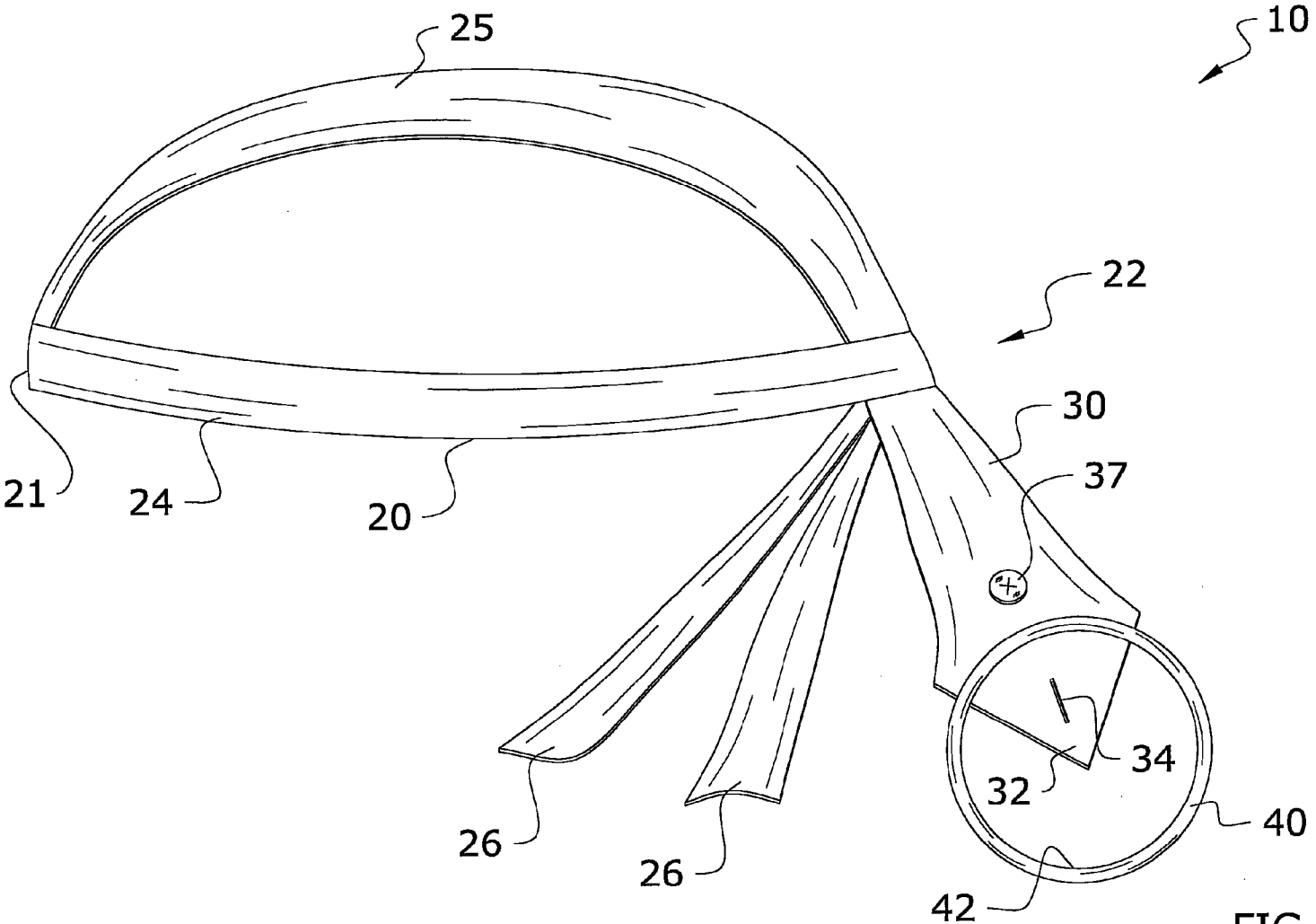
FIG. 2 is an upper perspective view of the first embodiment of the present invention with the flap in an unconnected position and the retaining element positioned upon the flap so as to be secured.
Figure 3:
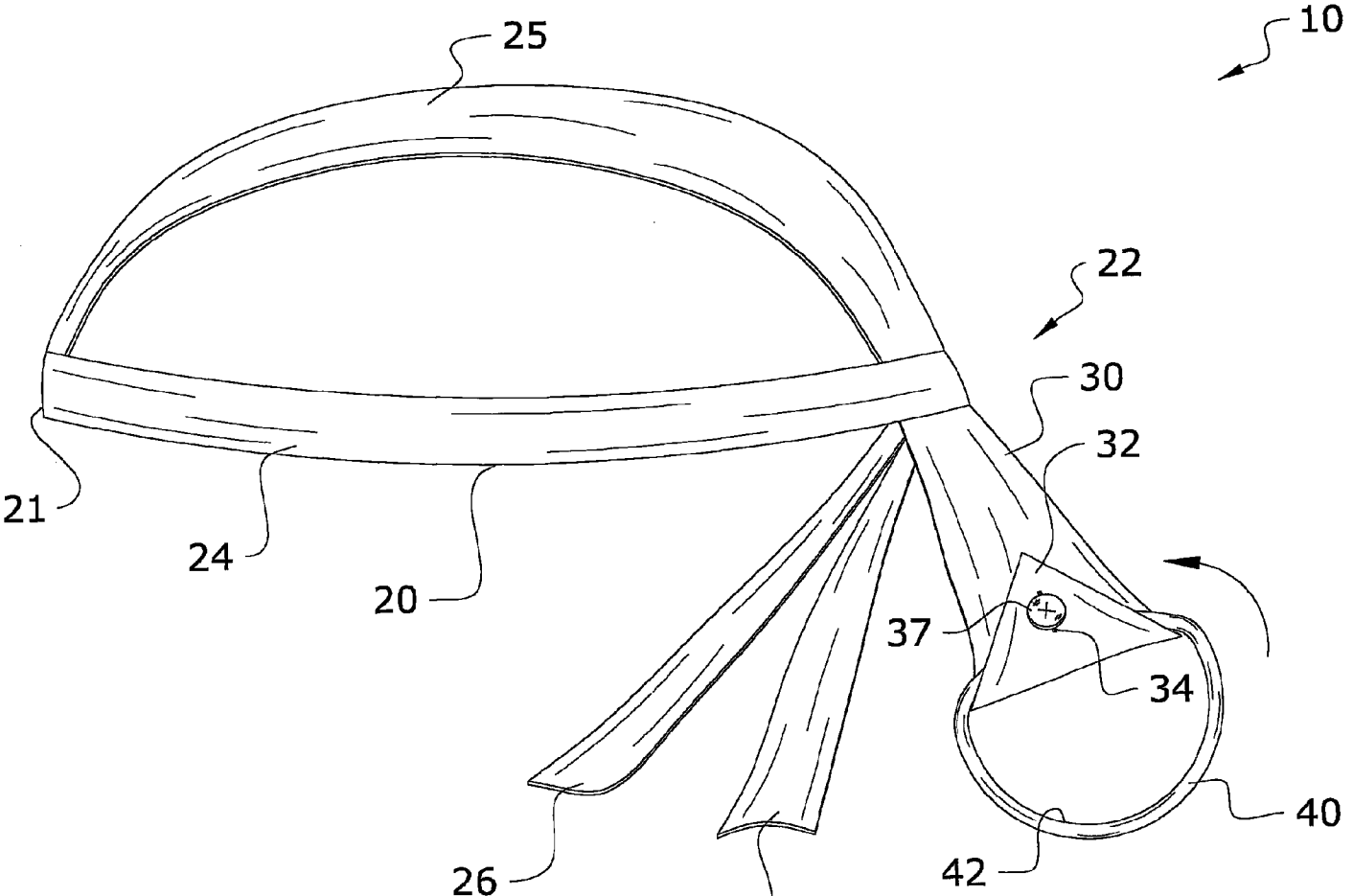
FIG. 3 is an upper perspective view of the first embodiment of the present invention with the flap in a connected position and the retaining element secured to the flap.

In a first configuration of the body 20 as illustrated in FIGS. 1 through 3, wherein the body 20 is comprised of a head wrap type configuration, the body 20 fits over the user's head without covering a substantial amount of the user's hair 12 atop their head. The body 20 includes a perimeter band 24 to extend around the perimeter of the user's head in a similar manner as a headband. A center strap 25 extends from the forward end 21 of the perimeter band 24 to the rearward end 22 of the perimeter band 24 so as to extend across the top of the user's head. When securing the first configuration of the body 20 to the user's head, the center strap 25 and the perimeter band 24 are secured in a taut manner around the user's head via tying, fastening, stretching or various other means. It is appreciated in the case of the tying, remainder strap portions 26 may extend down from the rearward end 22, wherein the remainder strap portions 26 may be left over from the center strap 25, perimeter band 24 or comprised of separate components all which efficiently allow the body 20 to be secured atop the head of the user. In this configuration, a flap 30 also extends from the rearward end 22 of the body 20, preferably directly from the center strap 25 so as to be centered with the user's head.

Figure 4:
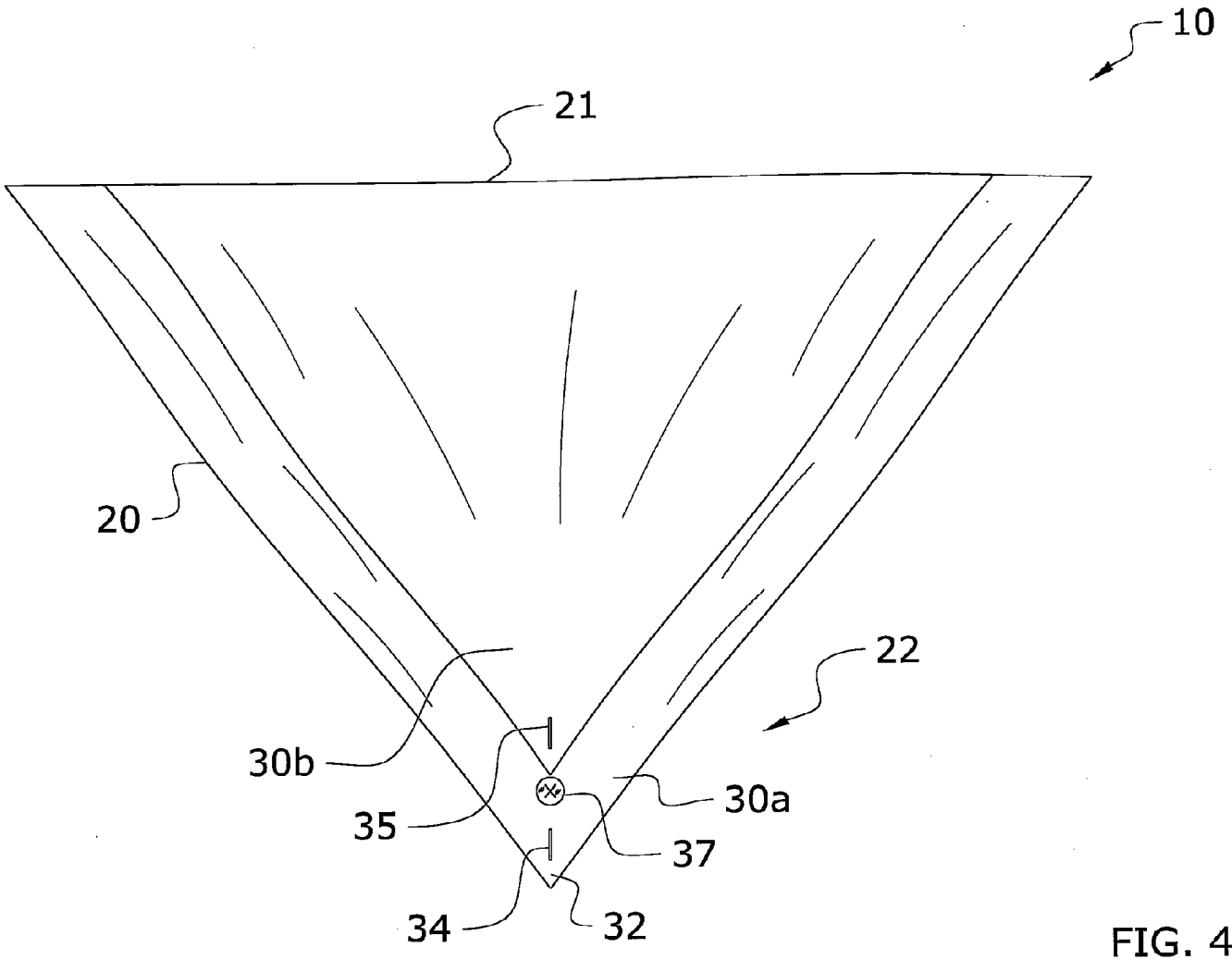
FIG. 4 is a top view of a second embodiment of the present invention with the body folded in half so as to be secured to the head of a user and the flaps in an unconnected position.
Figure 5:
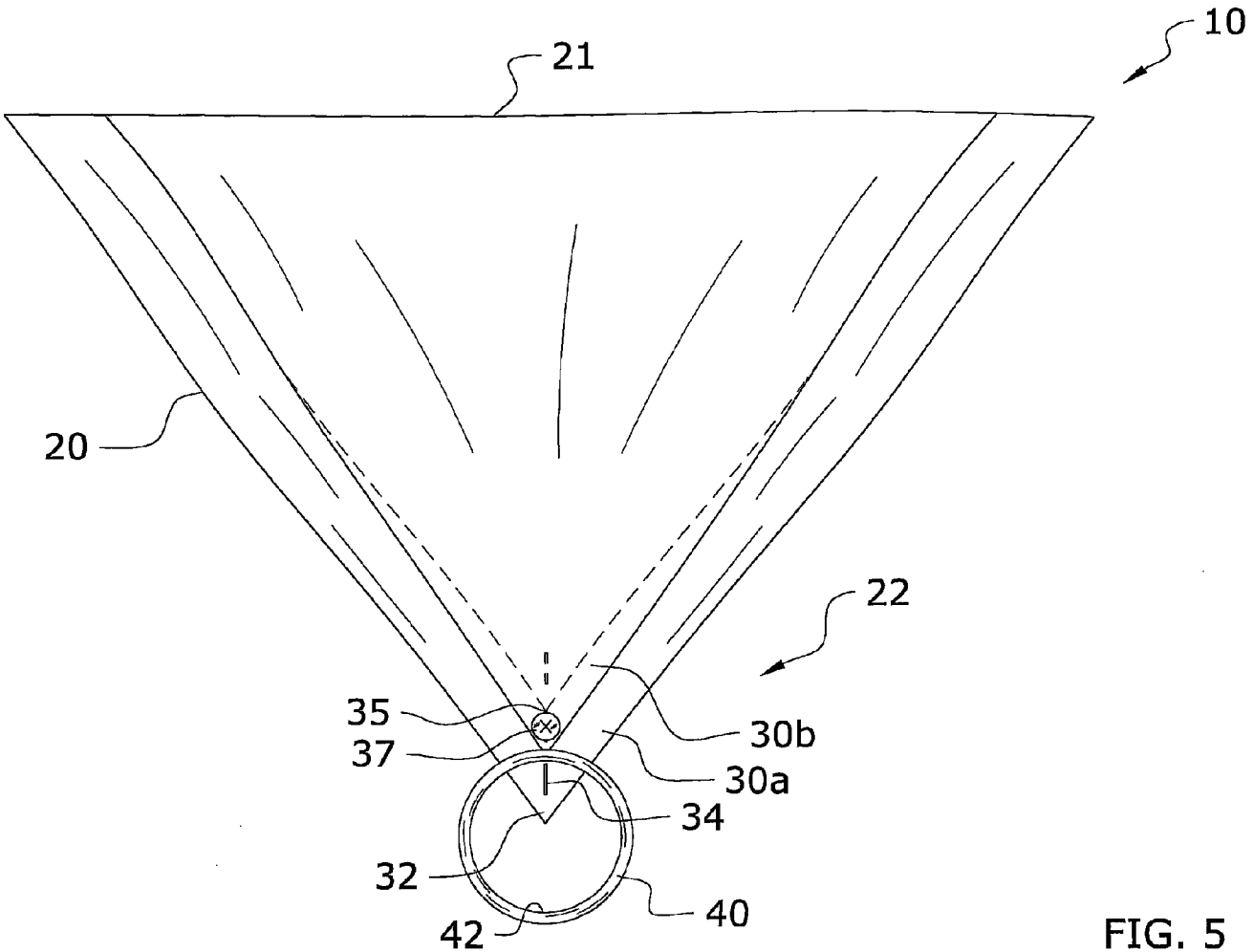
FIG. 5 is a top view of a second embodiment of the present invention with the first flap extended rearwardly so as to connect to the fastener and the retaining element positioned upon the second flap so as to be secured.
Figure 6:
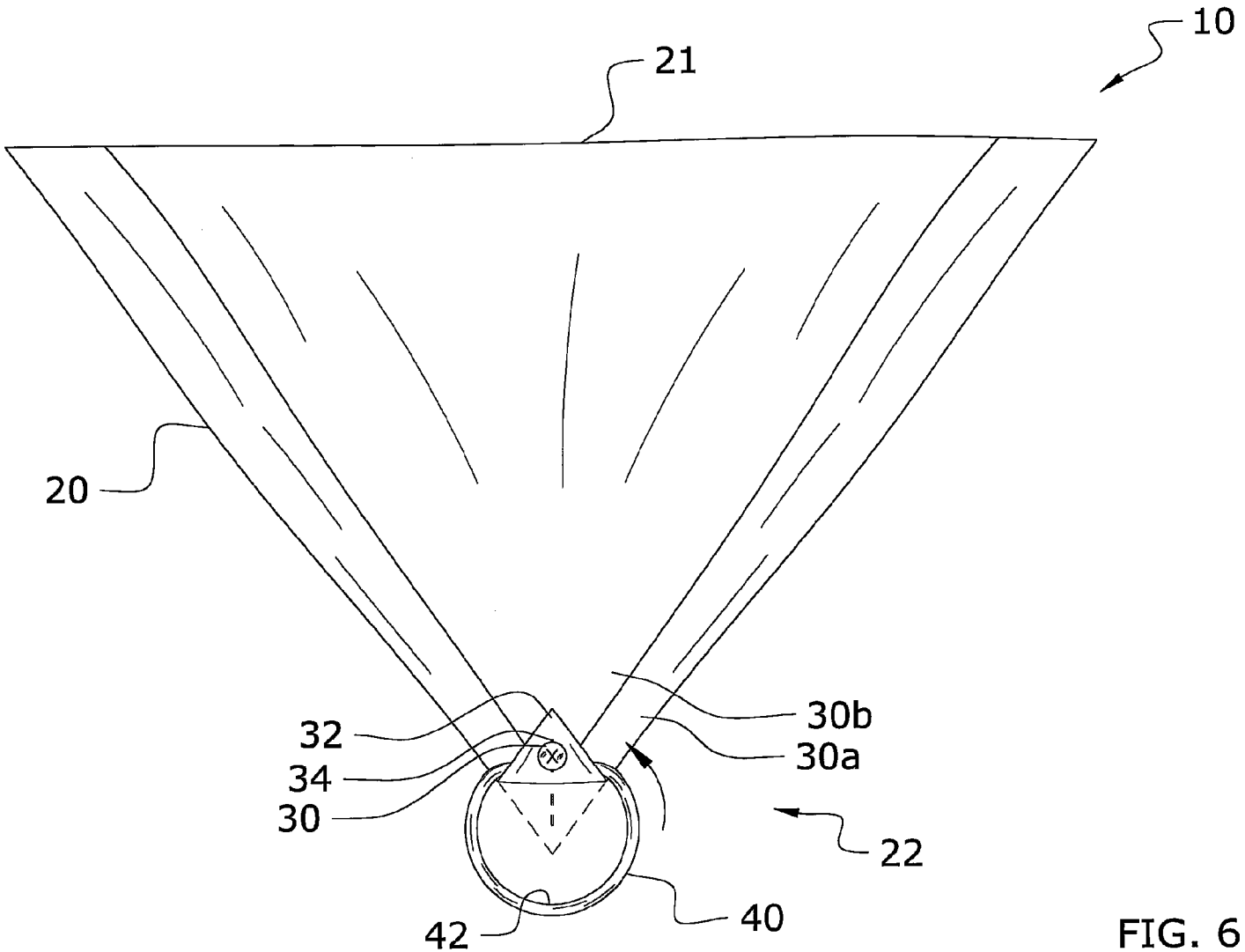
FIG. 6 is a top view of a second embodiment of the present invention with the flaps in a connected position and the retaining element secured to the second flap.

In a second configuration of the body 20 as illustrated in FIGS. 4 through 6, wherein the body 20 is comprised of a bandana type configuration, the body 20 fits over the user's head so as to cover a substantial amount of the user's hair 12 atop their head. The body 20 is comprised of a sheet configuration and secured to the user's head in a manner consistent with prior applications of bandanas or do-rags. When folding the sheet of the body 20 in half, as commonly done, two rearward end 22 flaps 30*a*, 30*b* are formed opposite the forward end 21 of the folded sheet (i.e. body 20). It is appreciated that the body 20 may be comprised of various other configurations and styles or combinations of the aforementioned configurations all which may be secured to the user's head.

C. Flaps

The flap 30 or flaps 30*a*, 30*b* extending from the body 20 along the rearward end 22 are used to secure the retaining element 40 to the body 20. The flap 30 or flaps 30*a*, 30*b* may be integral with the body 20 or may be comprised of a separate element extending from the body 20. In any part the flap 30 or flaps 30*a*, 30*b* are part of the rearward end 22 of the body 20.

In the first configuration as illustrated in FIGS. 1 through 3, the distal end 32 of the flap 30 (opposite the head of the user) includes an elongated slot 34 extending through. A fastener 37 (e.g. button, etc.) is secured to the flap 30 in a location proximately closer to the head of the user and main portion of the body 20. The slot 34 and the fastener 37 are preferably centrally aligned with the body 20 and the user so as to ensure that the retaining element 40 is centrally secured with respect to the user. The flap 30 is also preferably comprised of an elongated structure so that the slot 34 and the fastener 37 (substantially near the outer end of the flap 30) are positioned at a distance far enough away from the user's head so that the ponytail 14 or mass of hair 12 extending from underneath the body 20 may extend through the retaining element 40 in a manner that is comfortable and natural to the user. A loop is defined via the distal end 32 being connected to the fastener 37. It is appreciated that the flap 30 is generally flexible in nature so as to move in a slight manner with the cinctured ponytail 14. The flap 30 is also generally comprised of a freely moving structure, at least near the distal end 32 of the flap 30.

In the second configuration as illustrated in FIGS. 4 through 6, the two end corners of the sheet configuration of the body 20 comprise a first flap 30*a* and a second flap 30*b*. The flaps 30*a*, 30*b* are positioned proximate to each other at the rearward end 22 of the body 20. The first flap 30*a* includes a first slot 34 comprised of an elongated configuration and centered with the body 20 and the second flap 30*b* includes a second slot 35 comprised of an elongated configuration and centered with the body 20. The first flap 30*a* and portion of the body 20 extending from the first flap 30*a* is also generally positioned substantially under the second flap 30*b* and portion of the body 20 extending from the second flap 30*b*. The fastener 37 (e.g. button, etc.) is secured to the body 20 adjacent the first flap 30*a* (i.e. below the second flap 30*b*). A loop is defined via the first flap 30*a* and distal end 32 being secured to the fastener 37. It is appreciated that the flaps 30, 30*a*, 30*b* may be comprised of various other configurations and styles or combinations of the aforementioned configurations all which may secure the retaining element 40 in a position to receive a user's ponytail 14.

D. Retaining Element

The retaining element 40 is secured to the body 20 at the rearward end 22 of the body 20, wherein the retaining element 40 is further secured to the flaps 30, 30*a* of the body 20. The retaining element 40 is comprised of a configuration sufficient to receive and retain a ponytail 14 within the retaining element 40 through substantial movement and motion of the user due to exercise, activity, etc.

The retaining element 40 includes a receiver opening 42 extending through the retaining element 40 so that the retaining element 40 may form a cincture structure around the ponytail 14 extending through the receiver opening 42. The retaining element 40 is preferably comprised of a resilient and flexible configuration so as to be expanded when receiving the ponytail 14 through the receiver opening 42 and subsequently retract around the ponytail 14 so as to prevent the ponytail 14 from becoming loose of the retaining element 40. In the preferred embodiment, the retaining element 40 is comprised of a rubber band commonly used in hair 12 products to retain hair 12 in a given position. It is appreciated however that the retaining element 40 may be comprised of various other configurations all which retain the ponytail 14 within the retaining element 40.

E. Operation of Preferred Embodiment

In use, the body 20 is first secured to the head of the user over the hair 12. The body 20 is secured in a comfortably taut manner to the head, while allowing the ponytail 14 of the user to extend out from underneath the rearward end 22 of the body 20. If using a configuration consistent with or similar to the first embodiment of the flap 30 as illustrated in FIGS. 1 through 3, the retaining element 40 is positioned upon the flap 30 so that the distal end 32 of the flap 30 may be extended through the receiver opening 42, folded around a portion of the retaining element 40 so as to define a loop and secured to the fastener 37 via the slot 34.

If using a configuration consistent with or similar to the second embodiment of the flap 30*a*, 30*b* as illustrated in FIGS. 4 through 6, the second flap 30*b* is first extended slightly rearward so that the second flap 30*b* may be secured to the fastener 37 via the second slot 35 to prevent the second flap 30*b* and upper part of the body 20 from moving around while the headwear 10 is attached atop the user's head. The retaining element 40 is then positioned upon the first flap 30*a* so that the distal end 32 of the first flap 30*a* may be extended through the receiver opening 42, folded around a portion of the retaining element 40 so as to define a loop and secured to the fastener 37 via the first slot 34. It is appreciated that securing the second flap 30*b* to the fastener 37 may be optional, wherein the second flap 30*b* does not directly hold the retaining element 40, but ensures that the upper part of the body 20 does not move around while in use and may also help in ensuring the body 20 is secured to the user's head in a taut manner so as to have sufficient strength to hold the retaining element 40 and ponytail 14 extending through the retaining element 40. If the retaining element 40 were not to be used with the second embodiment, the second flap 30*b* may still be secured to the fastener to prevent the second flap 30*b* from flapping about while the headwear 10 is being worn by the user.

When the retaining element 40 is secured, the ponytail 14 may be extended through the receiver opening 42 so that the retaining element 40 may secure the ponytail 14 in a substantially fixed position to prevent the ponytail 14 from flailing about or getting in the way of the user. It is appreciated that once the ponytail 13 is secured within the retaining element 40, the ponytail may be twirled into a bun and tucked into the body 20 or alternately left to dangle in a secured manner from the retaining element 40. It is appreciated that the retaining element 40 may be removed at any time by disconnecting the flap 30, 30*a* from the fastener 37. The body 20 may be worn then in a manner without the retaining element 40 or may also be removed.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

I claim:

1. A hair retaining headwear system, comprising:

a body adapted to be worn over a head of a user, wherein said body includes a forward end adapted to extend around a forehead and a rearward end opposite said forward end; and a retaining element extending from said rearward end, wherein said retaining element includes a receiver opening to receive and retain hair extending from underneath said body away from said body;

wherein said rearward end includes at least one flap extending from said body;

wherein said at least one flap includes a distal end, wherein said distal end forms a loop;

wherein said at least one flap includes a fastener and a slot extending through said distal end, wherein said slot is secured to said fastener to form said loop.

2. The hair retaining headwear system of claim 1, wherein said retaining element is comprised of a cincture structure.

3. The hair retaining headwear system of claim 1, wherein said retaining element is comprised of a resilient structure.

4. The hair retaining headwear system of claim 3, wherein said retaining element is comprised of a rubber band.

5. The hair retaining headwear system of claim 1, wherein said retaining element is removably secured to said rearward end of said body.

6. The hair retaining headwear system of claim 1, wherein said loop receives said retaining element to secure said retaining element to said at least one flap.

7. The hair retaining headwear system of claim 1, wherein said body includes a perimeter band.

8. The hair retaining headwear system of claim 7, wherein said body includes a center strap connecting opposing ends of said perimeter band.

9. The hair retaining headwear system of claim 1, wherein said body is comprised of a sheet configuration.

10. The hair retaining headwear system of claim 9, wherein said body includes a first flap and a second flap, wherein said first flap includes a first slot and wherein said second flap includes a second slot.

11. The hair retaining headwear system of claim 10, wherein said first slot and said second slot are secured to a fastener extending from said body to secure said retaining element.

12. A hair retaining headwear system, comprising:

a body adapted to be worn over a head of a user, wherein said body includes a forward end adapted to extend around a forehead and a rearward end opposite said forward end; and a retaining element extending from said rearward end, wherein said retaining element includes a receiver opening;

wherein said retaining element is comprised of a rubber band configuration so as to expand and contract and thus form a cincture structure around a ponytail extending from underneath said body away from said body;

wherein said rearward end includes at least one flap extending from said body to removably secure said retaining element to said rearward end of said body;

wherein said at least one flap includes a distal end, wherein said distal end forms a loop;

wherein said at least one flap includes a fastener and a slot extending through said distal end, wherein said slot is secured to said fastener to form said loop;

wherein said loop receives said retaining element to secure said retaining element to said at least one flap.

13. A hair retaining headwear system, comprising:

a body adapted to be worn over a head of a user, wherein said body includes a forward end adapted to extend around a forehead and a rearward end opposite said forward end; and a retaining element extending from said rearward end, wherein said retaining element includes a receiver opening to receive and retain hair extending from underneath said body away from said body;

wherein said body is comprised of a sheet configuration;

wherein said body includes a first flap and a second flap, wherein said first flap includes a first slot and wherein said second flap includes a second slot.

14. The hair retaining headwear system of claim 13, wherein said first slot and said second slot are secured to a fastener extending from said body to secure said retaining element.

15. A hair retaining headwear system, comprising:

a body adapted to be worn over a head of a user, wherein said body includes a forward end adapted to extend around a forehead and a rearward end opposite said forward end; and a retaining element extending from said rearward end, wherein said retaining element includes a receiver opening to receive and retain hair extending from underneath said body away from said body;

wherein said rearward end includes at least one flap extending from said body;

wherein said at least one flap includes a distal end, wherein said distal end forms a loop;

wherein said loop receives said retaining element to secure said retaining element to said at least one flap.

* * * * *